US007635129B2

(12) United States Patent
Inoue

(10) Patent No.: US 7,635,129 B2
(45) Date of Patent: Dec. 22, 2009

(54) SHEET CONVEYING APPARATUS AND IMAGE FORMING APPARATUS

(75) Inventor: Nobuo Inoue, Ebina (JP)

(73) Assignee: Ricoh Company, Ltd, Tokyo (JP)

( * ) Notice: Subject to any disclaimer, the term of this patent is extended or adjusted under 35 U.S.C. 154(b) by 163 days.

(21) Appl. No.: 11/889,258

(22) Filed: Aug. 10, 2007

(65) Prior Publication Data

US 2008/0036140 A1 Feb. 14, 2008

(30) Foreign Application Priority Data

Aug. 11, 2006 (JP) ..... 2006-219378

(51) Int. Cl.
*B65H 7/02* (2006.01)

(52) U.S. Cl. ..... 271/258.01; 271/171

(58) Field of Classification Search ..... 271/171, 271/258.04

See application file for complete search history.

(56) References Cited

U.S. PATENT DOCUMENTS 5,667,215 A * 9/1997 Yoshino ..... 271/258.01
5,984,305 A 11/1999 Inoue
6,663,099 B2 12/2003 Inoue
2006/0164456 A1 7/2006 Yamagishi et al.
2006/0255531 A1* 11/2006 Azzopardi et al. ..... 271/171

FOREIGN PATENT DOCUMENTS

| | | |
|---|---|---|
| JP | 05-069985 | 3/1993 |
| JP | 05-170340 | 7/1993 |
| JP | 2004-155522 | 6/2004 |

* cited by examiner

*Primary Examiner*—David H Bollinger
(74) *Attorney, Agent, or Firm*—Harness, Dickey & Pierce, P.L.C.

(57) ABSTRACT

A sheet conveying apparatus that conveys a sheet serving as a recording medium and effectively reduces energy consumption includes a movable sheet supporting device configured to support sheets, a sheet size detecting device configured to detect a size of the sheets by detecting a location of the sheet supporting device, a gap detecting device configured to detect a gap between the sheets and the sheet supporting device, and a reporting device configured to notify an operator of a gap detected by the gap detecting device.

10 Claims, 6 Drawing Sheets

SHEET CONVEYING APPARATUS AND IMAGE FORMING APPARATUS

PRIORITY STATEMENT

The present patent application claims priority under 35 U.S.C. §119 from Japanese Patent Application No. 2006-219378, filed in the Japan Patent Office on Aug. 11, 2006, the content and disclosure of which are hereby incorporated by reference herein in their entirety.

BACKGROUND OF THE INVENTION

1. Field of the Invention

The present disclosure generally relates to a sheet conveying apparatus and an image forming apparatus using the same, for example, printers, facsimiles, copiers, and multi-functional machines including functions of printer, facsimile, and copier.

2. Discussion of the Related Art

A conventional image forming apparatus may include an image bearer, an image fixing device, a transfer-sheet storage device, a transfer-sheet size detecting device, a conveyance device, a transfer-sheet detecting device, a timing device, an operational device, and a control device. The control device uses a first threshold and a second threshold smaller than the first threshold for every transfer-sheet size. The first threshold is used for detecting a sheet jam on the transfer-sheet conveyance path.

When the transfer-sheet conveyance time of a sheet, which is determined by the transfer-sheet detecting device and the timing device, is longer than the first threshold, a sheet jam is diagnosed and the image forming operation is stopped immediately. When the transfer-sheet conveyance time is shorter than the first threshold but not shorter than the second threshold and this situation is detected two consecutive times or more, the transfer-sheet size is considered irregular. In this case, conveyance of the following transfer sheet is prohibited, and an image forming operation is stopped after forming an image on the already fed transfer-sheet and discharging the sheet from the image forming apparatus. When the transfer-sheet conveyance time is shorter than the first threshold but not shorter than the second threshold and this situation is not detected consecutively, an image forming operation is allowed to continue.

In the image forming apparatus, the sheet length is measured using a sheet sensor disposed along the sheet conveyance path. The sheet length is compared with two or more thresholds, the number of which is determined based on the sheet size preset in the image forming apparatus, to detect a sheet jam and a sheet of irregular size. When the sheet length is different from the preset sheet size, the sheet is ejected without stopping the conveyance (i.e., without regarding the situation as a sheet jam). Therefore, at least one sheet must be conveyed to diagnose a sheet jam. When the sheet size is erroneously preset, one sheet and ejecting energy are consumed in vain.

SUMMARY OF THE INVENTION

An embodiment of the present invention is directed to a sheet conveying apparatus and an image forming apparatus using the same, which convey a sheet serving as a recording medium and effectively reduce energy consumption. In the embodiment, a sheet conveying apparatus includes a movable sheet supporting device configured to support sheets, a sheet size detecting device configured to detect a size of the sheets by detecting a location of the sheet supporting device, a gap detecting device configured to detect a gap between the sheets and the sheet supporting device, and a reporting device configured to notify an operator of the existence of the gap detected by the gap detecting device.

Additional features and advantages of the present invention will be more fully apparent from the following detailed description of embodiments, the accompanying drawings and the appended claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
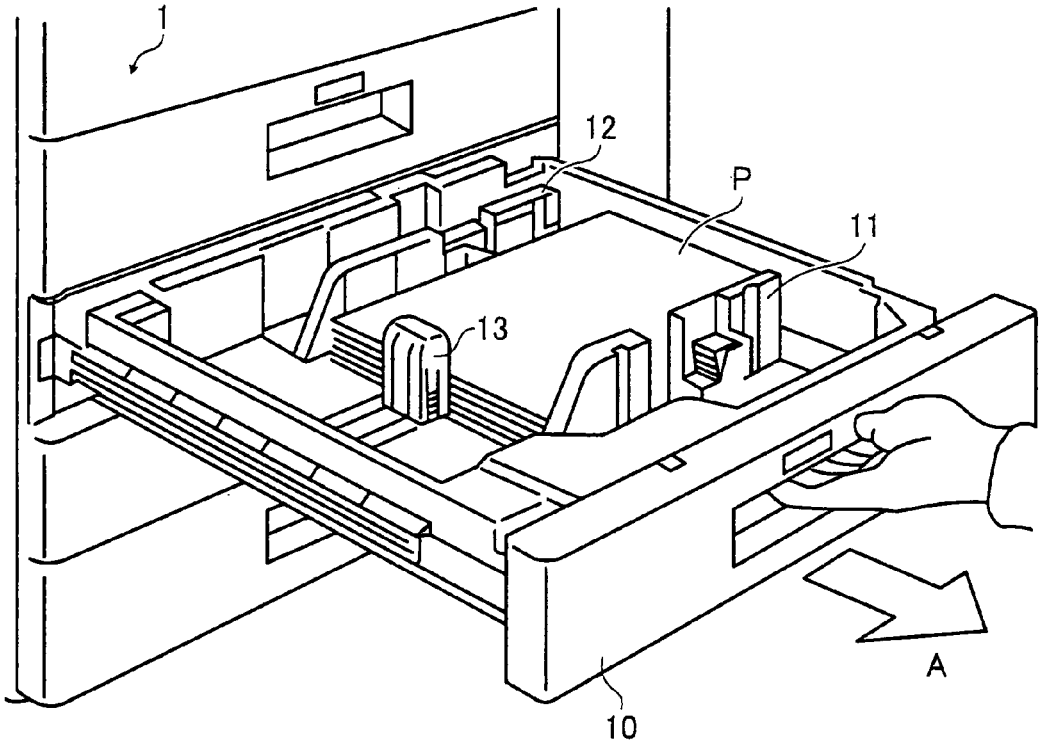
FIG. 1 is a perspective diagram showing a state in which a sheet feed tray is pulled out from an image forming apparatus according to an embodiment of the present invention.

Referring now to the drawings, wherein like reference numerals designate identical or corresponding parts throughout the several views, embodiments of the present disclosure, which are applied to a tandem-type color image forming apparatus, are explained below.

I the following description, it is to be understood that if an element or layer is referred to as being "on," "against," "connected to" or "coupled to" another element or layer, then it may be either directly on, against, connected or coupled to that other element or layer or intervening elements or layers may be present. By contrast, if an element is referred to as being "directly on", "directly connected to" or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Figure 9:
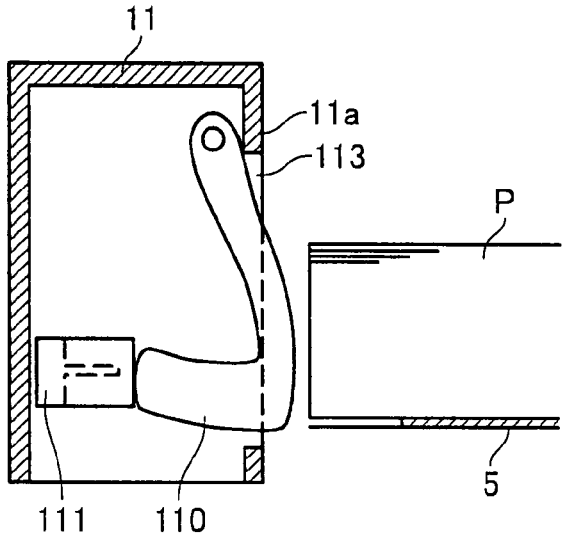
FIG. 9 is an expanded sectional view along a line Y-Y of FIG. 8.

Referring now to the drawings, wherein like reference numerals designate identical or corresponding parts throughout the several views, particularly to FIG. 9, an example of a feeding tray of an image forming apparatus according to embodiments is described.

Figure 2:
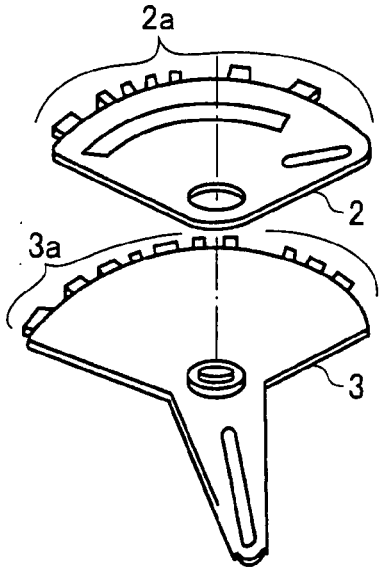
FIG. 2 is an exploded perspective view of a size detection board which constitutes a size detection device in the image forming apparatus of FIG. 1.
Figure 3:
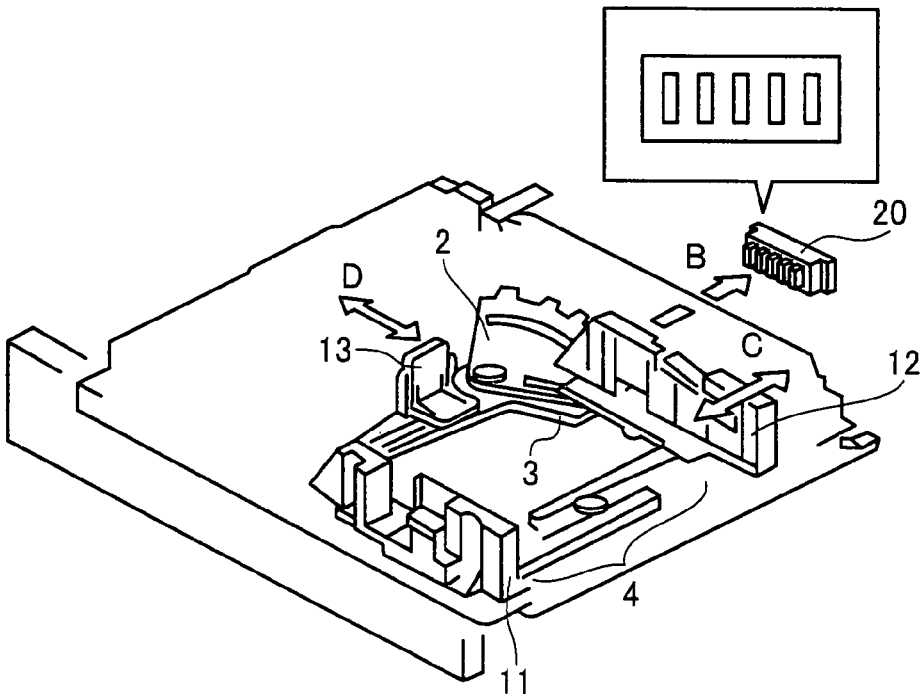
FIG. 3 is a perspective diagram showing a disposition of the size detection board in the image forming apparatus of FIG. 1.

FIGS. 1 through 3 illustrate an example of an image forming apparatus including an automatic size detection sheet feed tray, according to one embodiment of the present disclosure. FIG. 1 is a perspective diagram in the status that one of the sheet feed trays is pulled out from an image forming apparatus according to an embodiment of the present invention. FIG. 2 is an exploded perspective view of a size detection board which constitutes a size detection device in the image forming apparatus of FIG. 1. FIG. 3 is a perspective diagram showing the disposition of the size detection board in the image forming apparatus of FIG. 1.

In a sheet feeding unit 1 of the image forming apparatus, a sheet feed tray 10 is attached. Side fences 11 and 12, and an end fence 13 are attached to the sheet feed tray 10. A user pulls out the sheet feed tray 10 which stores recording sheets P in a direction A in FIG. 1. The side fences 11 and 12, and the end fence 13, are movable so as to hold the sheets P in various sizes in directions C and D in FIG. 3. When the positions of the side fences 11, 12 and the end fence 13 are fixed due to the size of the sheet P, the positions of size detection boards 2, 3 arranged on the back side of the sheet feed tray 10, which are rotated by a link mechanism, not shown, are fixed. Further, the combination of concavo-convex portions 2*a* and 3*a* of the size detection boards 2, 3, which varies depending on sheet size, is fixed. A push switch 20 detects the concavo-convex portions 2*a* and 3*a*. Therefore, the size of the sheets P in the sheet feed tray 10 is detected. That is, the size detection boards 2, 3 and the push switch 20 constitute a sheet size detection device. The side fences 11 and 12 are constituted so that they may move symmetrically to a centerline of the sheet P via a rack-and-pinion mechanism 4. The side fences 11 and 12 are movable parallel to the direction A in FIG. 1. The side fences 11 and 12 are movable perpendicular to the direction A in FIG. 1.

Figure 4:
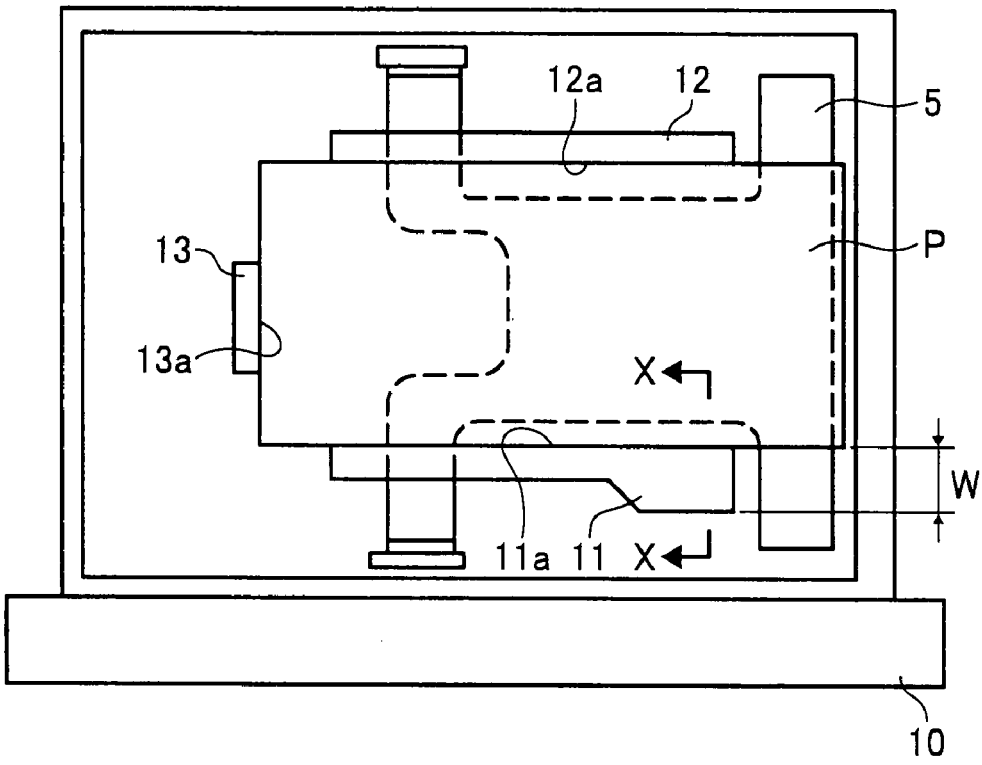
FIG. 4 is a plan view of a sheet feed tray in the image forming apparatus of FIG. 1.
Figure 5:
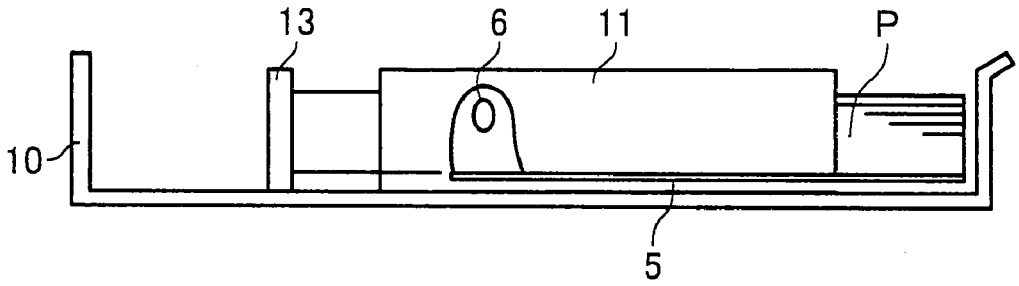
FIG. 5 is a cross-sectional view of the sheet feed tray of FIG. 4.
Figure 6:
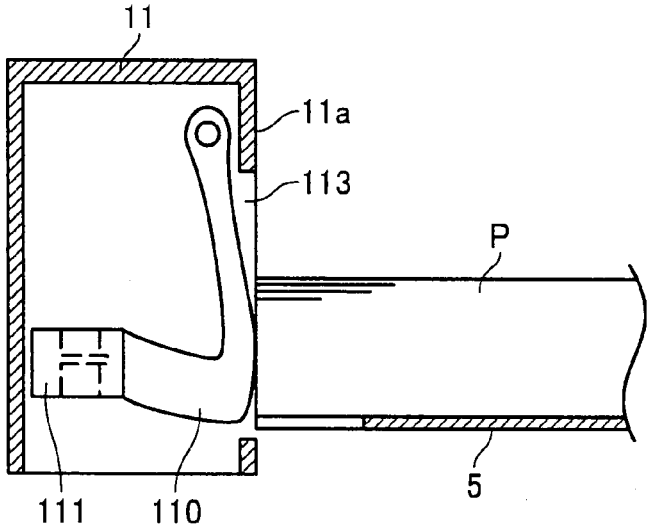
FIG. 6 is an expanded sectional view along a line X-X of FIG. 4.
Figure 7:
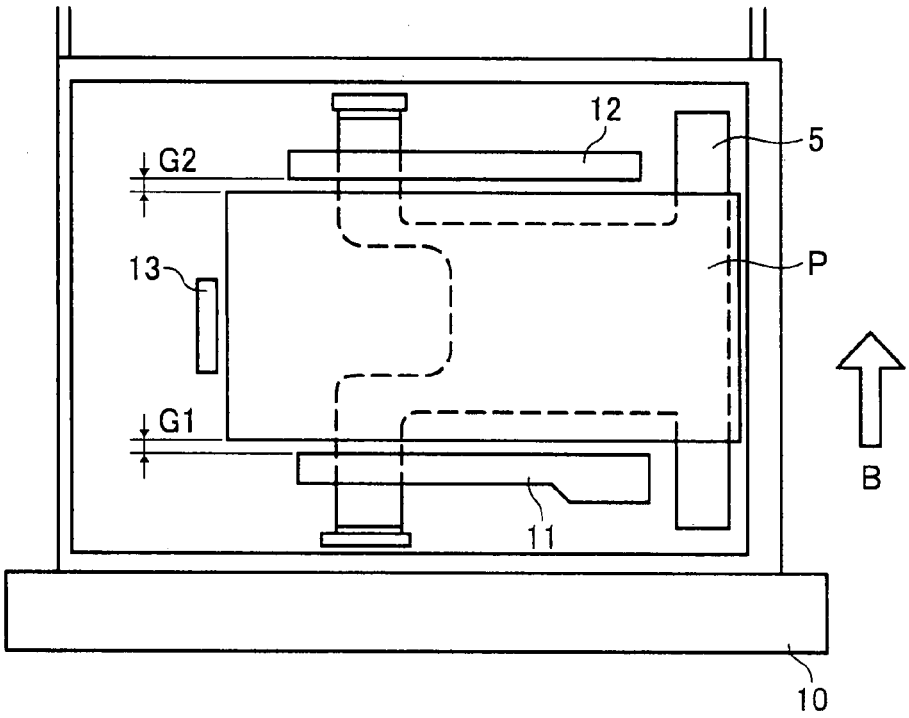
FIG. 7 is a plan view of an example of a sheet feed tray in the image forming apparatus of FIG. 1.
Figure 8:
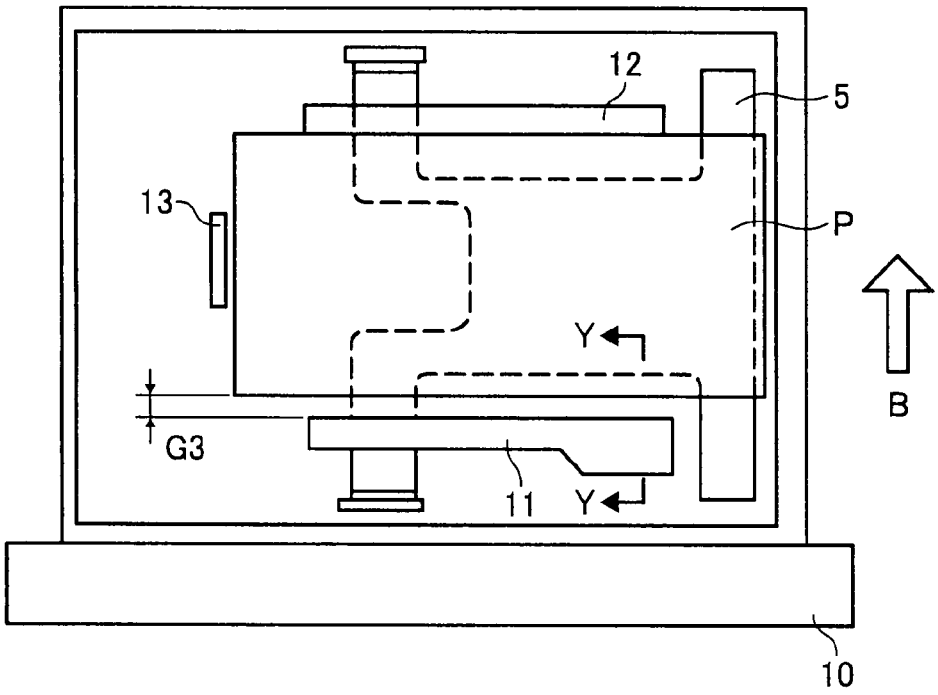
FIG. 8 is a plan view of an example of a sheet feed tray in the image forming apparatus of FIG. 1.
Figure 10:
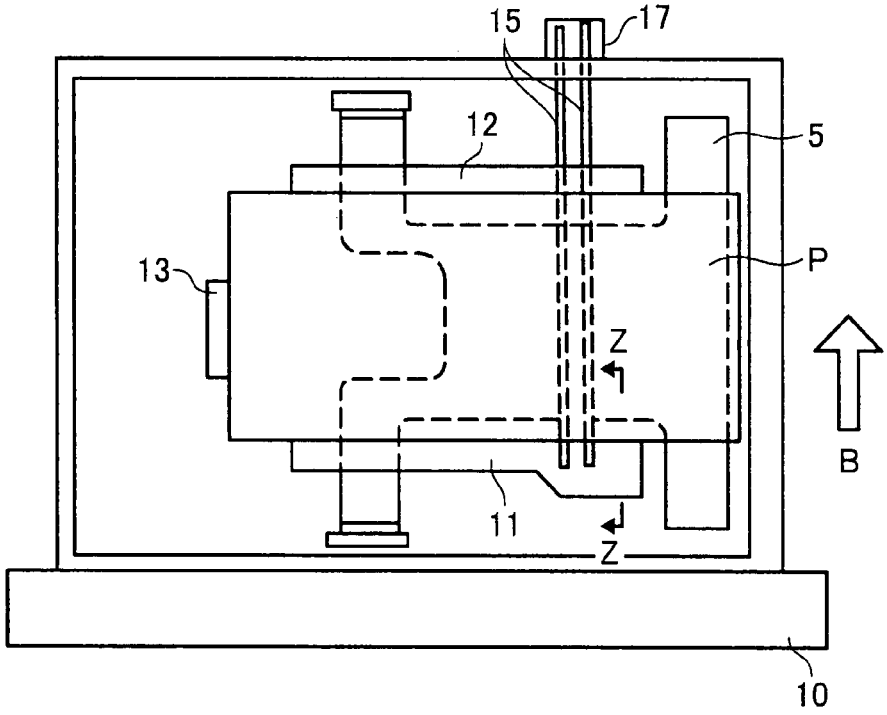
FIG. 10 is a plan view of another example of a sheet feed tray in the image forming apparatus of FIG. 1.
Figure 11:
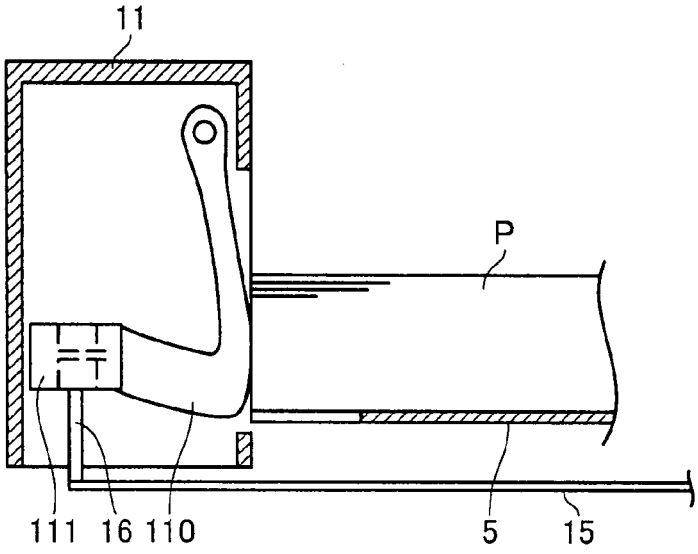
FIG. 11 is an expanded sectional view along a line Z-Z of FIG. 10.

FIGS. 4 through 11 illustrate examples of a sheet feed tray according to embodiments of the present disclosure. FIG. 4 is a plan view of a sheet feed tray in the image forming apparatus of FIG. 1. FIG. 5 is a cross-sectional diagram of the sheet feed tray of FIG. 4. FIG. 6 is an expanded sectional view along a line X-X of FIG. 4. FIG. 7 is a plan view of an example of a sheet feed tray in the image forming apparatus of FIG. 1. FIG. 8 is a plan view of an example of a sheet feed tray in the image forming apparatus of FIG. 1. FIG. 9 is an expanded sectional view along a line Y-Y of FIG. 8. FIG. 10 is a plan view of another example of a sheet feed tray in the image forming apparatus of FIG. 1. FIG. 11 is an expanded sectional view along a line Z-Z of FIG. 10. In FIGS. 4 and 5, the above-mentioned sheet size detection device is provided on the sheet feed tray 10. The size detection boards 2, 3 and the push switch 20 are not illustrated in FIGS. 4 and 5. A sole plate 5 is provided in the sheet feed tray 10. The side fences 11 and 12 and the end fence 13 position the sheets P on the sole plate 5. When the sheet feed tray 10 is pushed into the sheet feeding unit 1 in a direction B in FIG. 7, the sole plate is elevated with an elevating mechanism, not shown, in which a supporting point 6 is used for elevating. Therefore, the sheets P are elevated up to a given position, and fed one by one with a separating mechanism, not shown. The sheet feed tray 10 can be pushed into the sheet feeding unit 1, and can be pulled out from the sheet feeding unit 1. When the sheet feed tray 10 is pulled out from the sheet feeding unit 1, the sheets P can be supplied, and the side fences 11 and 12 and the end fence 13 can be moved to attach to and detach from the end of the sheets P.

The side fences 11 and 12 are box-type hollow objects. The side fence 11 has a side surface 11*a* which contacts an end of the sheets P. The side fence 12 has a side surface 12*a* which contacts an end of the sheets P. Therefore, the side fences 11 and 12 support the sheets P. In FIG. 4, a right end of the side fence 11 has a width W which is wider than a left end of the side fence 11. In FIG. 6, a gap detection sensor 111 and a gap detection filler 110 as a gap detection device are arranged in the hollow of the side fence 11. In FIG. 9, the gap detection filler 110 protrudes to the end of the sheets P through an opening 113 in the side fence 11 when there is a gap between the side surface 11*a* and the end of the sheets P. The gap between the side surface 11*a* and the end of the sheets P tends to arise because the sheets P tend to move toward the rear side by inertia when the sheet feed tray 10 is pushed into the sheet feeding unit 1. Therefore, the gap detection sensor 111 and the gap detection filler 110 are provided in the hollow of the side fence 11.

The end fence 13 is a box-type hollow object. The end fence 13 has a side surface 13*a* which contacts an end of the sheets P. It should be noted that the end fence 13 and the side fence 12 are not necessarily hollow objects.

When there is little gap between the end of the sheets P and the side surface of the side fences 11 and 12 as shown in FIG. 4, the gap detection filler 110 is in the hollow of the side fence 11 as shown in FIG. 6. Therefore, a lower part of the gap detection filler 110 blocks light in the gap detection sensor 111, and the gap detection sensor 111 can judge the gap. Further, a sheet size may be detected by the size detection boards 2, 3 and the push switch 20 without error.

When a user sets the side fences 11 and 12 having gaps G1 and G2 as shown in FIG. 7, or when the side fences 11 and 12 are moved to have the gaps due to a fault of a stopper, not shown, the size detection boards 2, 3 rotate to irregular positions. Therefore, a detecting result of a sheet size by the push switch 20 which detects the concavo-convex portions 2*a* and 3*a* is different from the sheet size of the sheets P. When the sheets P are fed without noticing the difference, a sheet jam, a skew, or a fault of image positioning may occur.

When there are gaps G1 and G2 as shown in FIG. 7, or a gap G3 between the side surface 11*a* and the end of the sheets P as shown in FIG. 8, the gap detection filler 110 protrudes to the end of the sheets P through the opening 113 in the side fence 11 as shown in FIG. 9. Therefore, the gap detection sensor 111 may not detect the gap correctly, and the sheet size may not be detected correctly by the size detection boards 2, 3 and the push switch 20.

When the detection sensor 111 cannot detect the gap correctly, it is assumed that there is the gap G3 between the side surface 11*a* and the end of the sheets P as shown in FIG. 8, and this information is sent to a controller, not shown, of a main body of the image forming apparatus. Further, the controller sends a message to a user using a display, not shown, and the existence of the gap G3 is reported to a user. The user resets the sheets P so as not to have the gap G3. A warning on the display and/or an audio warning may be used to inform the user.

The user who receives notification of the existence of the gap G3 adjusts the position of the side fence 11 (and by necessity the side fence 12), thus reducing the gap G3. Thereby, as mentioned above, the sheet size may be detected correctly by the size detection boards 2, 3 and the push switch 20.

As mentioned above, the gap detection information shows whether the disposition of the sheet P within the sheet feed tray 10 is correct. Therefore, energy cost is reduced because it is not necessary to convey at least one sheet in vain to detect an error of the sheet size. Further, the gap detection filler 110 constantly contacts the end of the sheet P and the gap is securely detected irrespective of the number of the sheets P.

Another example is explained with reference to FIG. 10 and FIG. 11. The composition of this example is almost the same as that of the above-mentioned example, and the same reference numerals are given to identical parts and a description thereof is omitted. A different composition is explained below. In FIG. 10 and FIG. 11, the gap detection sensor 111 electrically connects to an electric conduction rail 15 provided in the sheet feed tray 10 through a sliding member 16 provided in the side fence 11. When the sheet feed tray 10 is set in the sheet feeding unit 1, the electric conduction rail 15 is electrically connected through a connector 17. That is, when the side fence 11 is moved, the sliding member 16 slides along the electric conduction rail 15. Therefore, the electric connection is maintained irrespective of the location of the side fence 11. The electric conduction rail 15 is provided under the sole plate 5 and parallel to a direction B in FIG. 10. One end of the electric conduction rail 15 connects the connector 17 on the outside surface of the sheet feed tray 10. The other end of the electric conduction rail 15 contacts the lower part of the sliding member 16.

The gap detection filler 110 has a curved surface or a beveling form surface which faces the sheets. As shown in FIG. 9 and FIG. 11, a protruding portion of the gap detection filler 110 from the side fence 11 is curved. Therefore, the sheets are not caught by the gap detection filler 110 when the sheet feed tray 10 is supplied with the sheets from various directions (e.g. up, side, slant), and the gap detection filler 110 smoothly moves into the side fence 11.

When there is little gap between the end of the sheets P and the side surface of the side fences 11 and 12 as shown in FIG. 10, the gap detection filler 110 is in the hollow of the side fence 11 as shown in FIG. 11. Therefore, a lower part of the gap detection filler 110 blocks light in the gap detection sensor 111 and the gap detection sensor 111 can judge the gap. Further, a sheet size may be detected by the size detection boards 2, 3 and the push switch 20 without error. In this example, when there are gaps G1 and G2 as shown in FIG. 7, or a gap G3 between the side surface 11*a* and the end of the sheets P as shown in FIG. 8, the gap detection filler 110 protrudes to the end of the sheets P through the opening 113 of the side fence 11 as shown in FIG. 9. Therefore, the gap detection sensor 111 may not detect the gap correctly, and the sheet size may not be detected correctly by the size detection boards 2, 3 and the push switch 20. Further, a controller sends a message to a user using a display, not shown, and the existence of the gap is reported to the user. The user may then reset the sheets P so as not to have the gap.

Since the gap detection filler 110 hangs down by the self-weight, it can evacuate in the side fence 11 with the small load intensity by the sheets. However, the gap detection filler 110 can easily swing at the opening and closing of the sheet feed tray 10. Therefore, the gap detection sensor 111 can make an error. For this problem, the gap detection sensor 111 is controlled so as not to detect during a given period after turning on electricity. This may reduce the detecting error. The given time may be about from 1 to 2 seconds. The side of the gap detection sensor 111, which faces the sheets, may be constituted with heavy materials so as to reduce the easiness of the swing.

This example has the gap detection sensor 111, the electric conduction rail 15, the sliding member 16, and the connector 17 in the sheet feed tray 10. Therefore, a location of the gap detection filler 110 may be detected irrespective of the sheet size in the sheet feed tray 10.

Although desirable examples of the gap detection sensor 111 and the gap detection filler 110 are shown, as long as the same effect can be expected other members, such as photosensors or microswitches, may be used. In addition, the gap detection device is provided in the side fence 11. However, alternatively, it may be provide in the side fence 12. Moreover, the sheet feeding unit is provided in the image forming apparatus. However, alternatively, it may be provide in a scanner apparatus. Finally, a film type sheet may be used as the sheet P. It should be noted that design details may be changed and corrected arbitrarily in the implementation of the present invention in its several embodiments.

Furthermore, in the above-described embodiments, descriptions are provided using examples in which the subject matter of the present disclosure is applied to the tandem-type color image forming apparatus. However, it is to be understood that the subject matter of the present disclosure may be applied to other image forming apparatuses such as printers, facsimiles and so forth, and also to a multi-functional image forming apparatus.

The embodiments being thus described, it should be apparent to one skilled in the art after reading this patent specification that the same may be varied in many ways. Such variations are not to be regarded as a departure from the spirit and scope of the present disclosure, and all such modifications as would be apparent to one skilled in the art are intended to be included within the scope of the following claims.

What is claimed is:

1. A sheet conveying apparatus, comprising:

a movable sheet supporting device configured to support sheets;

a sheet size detecting device configured to detect a size of the sheets by detecting a location of the sheet supporting device;

a gap detecting device configured to detect a gap between the sheets and the sheet supporting device;

a reporting device configured to notify an operator of a gap detected by the gap detecting device; and a sheet storage device configured to store the sheets to be conveyed, movable in directions so as to be attachable to and detachable from the sheet conveying apparatus, wherein the sheet supporting device is movable in the directions.

2. The sheet conveying apparatus of claim 1, wherein the gap detecting device is located in the sheet supporting device, and the sheet supporting device moves reciprocally in front-to-rear and rear-to-front directions from a viewpoint of an operator setting the sheets in the sheet conveying apparatus.

3. The sheet conveying apparatus of claim 1, wherein the gap detecting device is located in the front sheet supporting device.

4. The sheet conveying apparatus of claim 1, wherein the gap detecting device is electrically connected with an outside controller when the sheet conveying apparatus is set up, and the gap detecting device does not detect during a given period after the electric connection.

5. The sheet conveying apparatus of claim 1, wherein the reporting device includes a display member to visually notify the operator of the gap.

6. The sheet conveying apparatus of claim 1, wherein the reporting device includes a voice generating member to acoustically notify the operator of the gap.

7. The sheet conveying apparatus of claim 1, wherein the sheet supporting device includes a hollow member, wherein a hollow extends along an end of the sheets.

8. The sheet conveying apparatus of claim 7, wherein the gap detecting device comprises:

a gap detecting filler located in the hollow, wherein an upper portion of the gap detecting device is pivotally supported and a lower portion thereof extends toward the sheets from an opening in the sheet supporting device when there is a gap between the sheets and the lower portion while not extending when there is no gap therebetween; and a gap detecting sensor configured to detect whether there is a gap or not between the sheets and the sheet supporting device, wherein the gap detecting sensor does not detect the gap detecting filler when the lower portion of the gap detecting filler extends toward the sheets and detects the gap detecting filler when the lower portion does not extend from the opening.

9. The sheet conveying apparatus of claim 8, wherein the gap detecting filler has a beveling form surface which faces the sheets.

10. An image forming apparatus comprising:

a sheet conveying apparatus configured to convey a sheet; and an image forming device configured to form an image on the sheet, wherein the sheet conveying apparatus is the sheet conveying apparatus of claim 1.

* * * * *